US009212490B1

(12) United States Patent
Ealer, Sr.

(10) Patent No.: US 9,212,490 B1
(45) Date of Patent: Dec. 15, 2015

(54) GUTTER COVER WITH FRONT LOUVER DRAINS

(71) Applicant: James E. Ealer, Sr., St. Clair, MO (US)

(72) Inventor: James E. Ealer, Sr., St. Clair, MO (US)

( * ) Notice: Subject to any disclaimer, the term of this patent is extended or adjusted under 35 U.S.C. 154(b) by 0 days.

(21) Appl. No.: 14/184,894

(22) Filed: Feb. 20, 2014

(51) Int. Cl.
*E04D 13/064* (2006.01)
*E04D 13/072* (2006.01)
*E04D 13/076* (2006.01)

(52) U.S. Cl.
CPC ..... *E04D 13/076* (2013.01); *E04D 13/064* (2013.01); *E04D 13/0727* (2013.01)

(58) Field of Classification Search
CPC ..... E04D 13/04; E04D 13/064; E04D 13/068; E04D 13/0685; E04D 13/072; E04D 13/0722; E04D 13/0725; E04D 13/076; E04D 2003/086; E04D 2003/0866; E04D 2003/0413; E04D 13/01727
USPC ..... 248/48.1, 48.2; 52/11, 13, 14, 15
See application file for complete search history.

(56) References Cited

U.S. PATENT DOCUMENTS

| | | | | |
|---|---|---|---|---|
| 2,209,741 | A | 7/1940 | Sullivan et al. | |
| 5,271,191 | A | 12/1993 | Vahamaki | |
| 5,471,798 | A * | 12/1995 | Kuhns | 52/12 |
| 6,151,837 | A * | 11/2000 | Ealer, Sr. | 52/12 |
| 6,968,651 | B2 | 11/2005 | Bergeron | |
| 7,104,011 | B1 * | 9/2006 | Knight | 52/12 |
| 7,581,356 | B1 * | 9/2009 | Balkum et al. | 52/12 |
| 7,627,991 | B1 | 12/2009 | Feldhaus | |
| 7,650,720 | B2 | 1/2010 | Ealer, Sr. | |
| 7,765,742 | B2 | 8/2010 | Ealer, Sr. | |
| 8,402,697 | B1 | 3/2013 | Ealer, Sr. | |
| 2006/0107603 | A1 * | 5/2006 | Brownridge | 52/11 |
| 2006/0265968 | A1 * | 11/2006 | Lowrie | 52/11 |
| 2008/0134587 | A1 * | 6/2008 | Ealer | 52/12 |

* cited by examiner

*Primary Examiner* — Jessica Laux
(74) *Attorney, Agent, or Firm* — Senniger Powers LLP

(57) ABSTRACT

A gutter cover for covering a gutter supported by gutter hangers is disclosed. The gutter cover has a central portion and a front portion configured to extend downward from the central portion to contact front portions of the gutter hangers. The front cover portion includes a plurality of louver drains, each of which comprises a drain opening and a raised louver above the drain opening.

25 Claims, 10 Drawing Sheets

GUTTER COVER WITH FRONT LOUVER DRAINS

BACKGROUND OF THE INVENTION

The present invention relates generally to rain gutters and more particularly to a gutter cover for preventing debris from falling into such gutters.

Since leaves and other debris frequently clog up rain gutters, some kind of guard or cover which prevents debris from falling into the gutter is desirable. Ideally, a gutter cover directs water into the gutter, prevents debris from entering the gutter, does not itself become clogged with debris and is securely attached to the gutter. The ideal gutter screen requires no maintenance after installation.

Reference may be made to U.S. Pat. Nos. 4,907,381, 5,893,240, 6,151,837, 7,650,720, 7,765,742, 7,891,142, 8,146,218, D638,920, and D683,827 disclosing gutter screens incorporating my inventions.

SUMMARY OF THE INVENTION

In general, a first embodiment of this invention is directed to an elongate gutter cover for covering a gutter supported by a gutter hanger. The gutter has front, back and bottom walls and a flange projecting rearward from the front wall and spaced above the bottom wall of the gutter. The gutter cover comprises a central portion and a front portion formed integrally with the central portion and configured to extend downward to contact a front portion of the gutter hanger. The front cover portion includes a plurality of louver drains, each of which comprises a drain opening and a louver for directing water through the drain opening into the gutter.

In another embodiment, this invention is directed to a gutter system comprising an elongate gutter having front, back and bottom walls and a flange projecting rearward from the front wall and spaced above the bottom wall of the gutter. The system also includes a hanger supporting the gutter. The hanger has a front hanger portion extending up along the front wall of the gutter below the gutter flange, and a rear hanger portion extending up along the back wall of the gutter. The system also includes a gutter cover covering the gutter. The gutter cover comprises a central cover portion and a front cover portion formed integrally with the central cover portion and configured to extend downward for contact with the front hanger portion. The front cover portion includes a plurality of louver drains, each of which comprises a drain opening and a raised louver above the drain opening.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
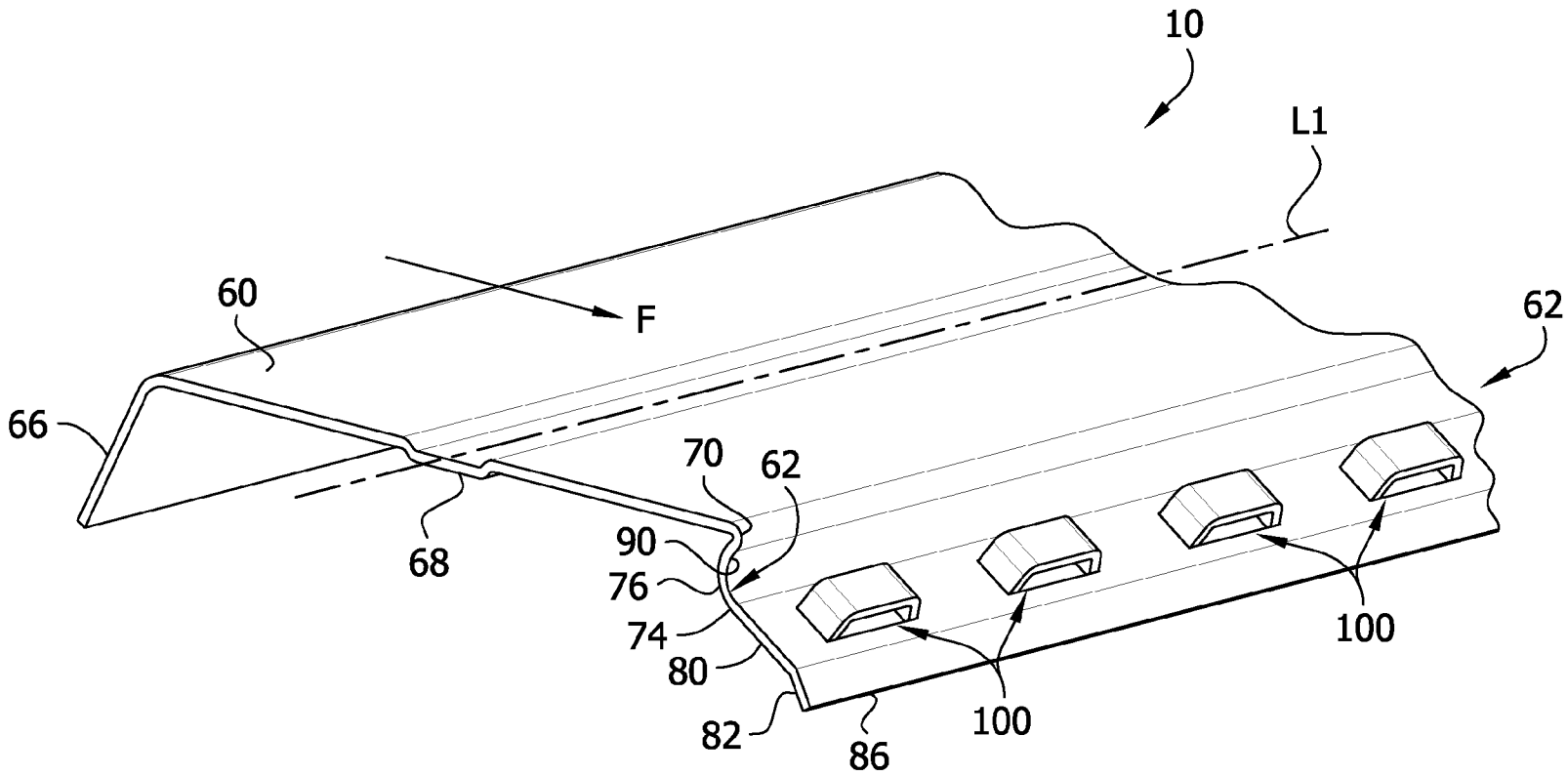
FIG. 1 is a perspective view of a first embodiment of a gutter cover of this invention.
Figure 2:
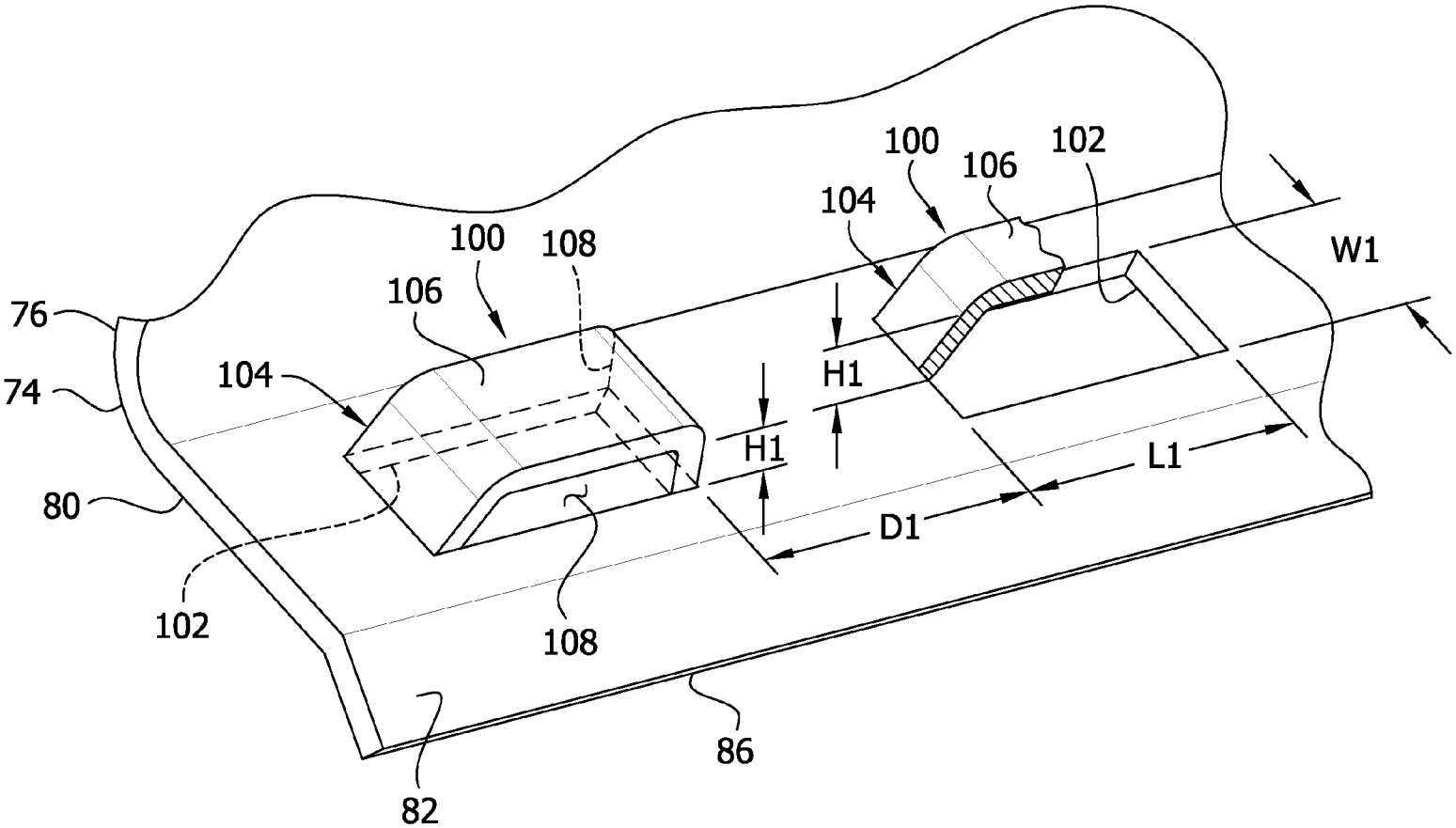
FIG. 2 is an enlarged portion of FIG. 1 showing louver drains of the gutter cover, portions of one louver drain being broken away to show details of a drain opening.
Figure 3:
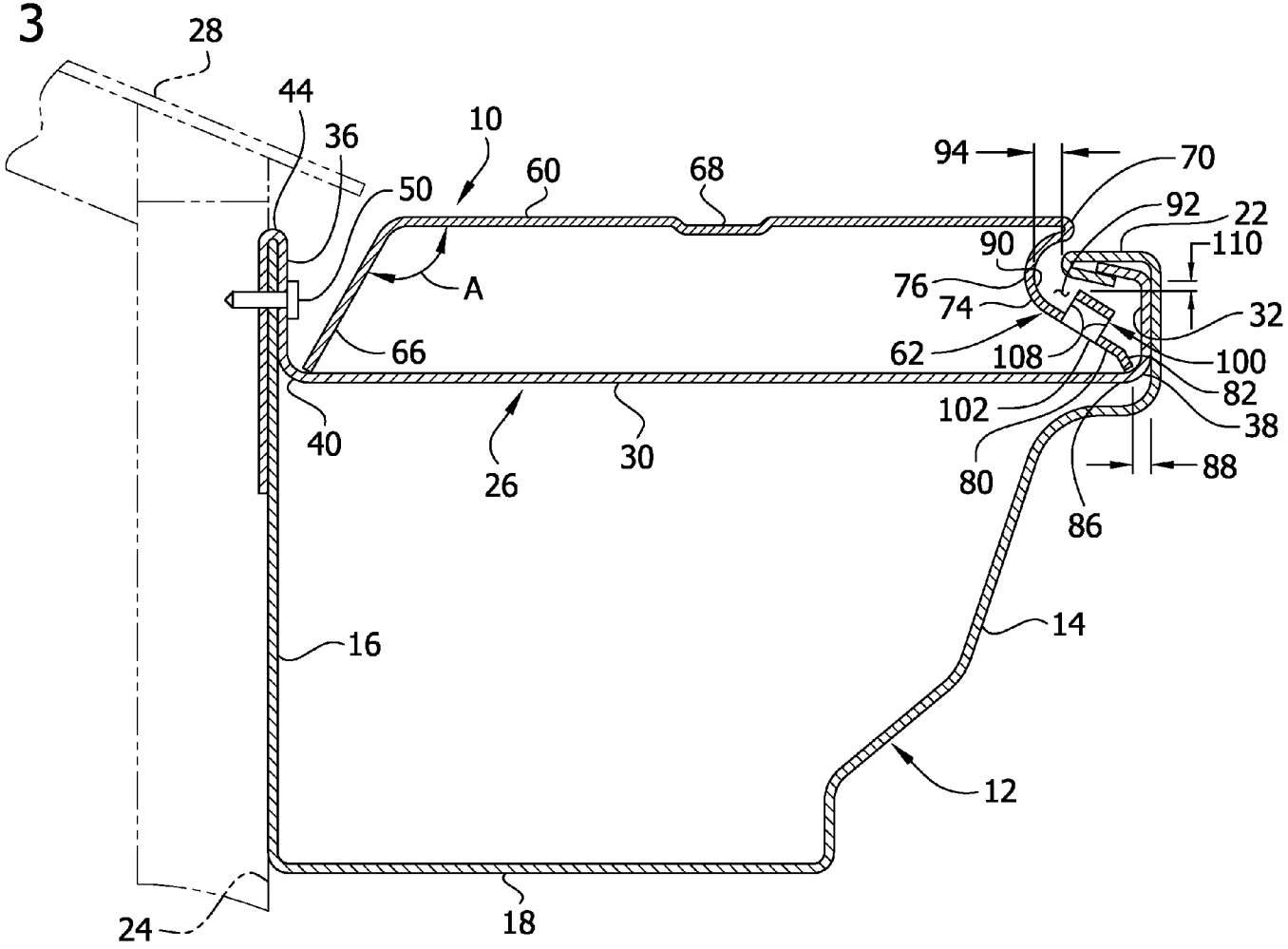
FIG. 3 is a transverse cross-sectional view of the gutter cover of FIG. 1 as installed on a gutter.

Referring now to the drawings, FIGS. 1-3 illustrate a first embodiment of a gutter cover of my invention, generally designated 10. The gutter cover 10 is shown in a properly installed position on a rain gutter 12 to prevent debris from falling into the gutter while allowing the passage of water into the gutter. As shown in FIG. 3, the gutter 12 has a front wall 14, a back wall 16 and a bottom wall 18, all of which combine to form a channel for drainage of rainwater. A conventional flange 22 projects rearward (i.e., toward the building to which the gutter is attached) from the upper edge of the front wall 14. The gutter 12 is suitably attached to a wall 24 of the building by gutter hangers 26 to collect rainwater flowing off a downwardly sloping roof 28 of the building.

Each gutter hanger 26 has a generally horizontal central hanger portion 30, an upright front hanger portion 32 extending up from the central hanger portion to a location below the gutter flange 22, and an upright rear hanger portion 36 extending up from the central hanger portion generally at the back wall 16 of the gutter. The front hanger portion 32 is connected to the central hanger portion 30 by a front hanger bend 38, and the rear hanger portion 36 is connected to the central hanger portion by a rear hanger bend 40. The upper end of the front hanger portion 32 is configured to fit inside the gutter flange 22 to reinforce the front wall 14 of the gutter against outwardly directed forces, such as caused by someone pulling on the gutter while climbing onto the roof 28. The upper end of the rear hanger portion 36 is bent at 44 to hook over the back wall 16 of the gutter 12. The rear hanger portion 36 is secured to the wall 14 by a fastening device 50, such as a screw or nail, to secure the gutter hanger to the wall 24 adjacent the roof 28 of the building.

As illustrated in FIGS. 1 and 3, the gutter cover 10 comprises an elongate sheet of substantially continuous non-perforated material (e.g., metal, vinyl, or other plastic sheet) having a longitudinal axis L1 transverse to the direction of water flow F down the roof. In its installed position (FIG. 3), the cover 10 has a substantially flat central cover portion 60, a front cover portion 62 formed integrally with the central cover portion and configured to extend downward to contact the front portion 32 of the gutter hanger at the front bend 38 of the hanger, and a rear cover portion 66 formed integrally with the central portion 60 and configured to extend downward to contact the rear portion of the gutter hanger at the rear bend 40 of the gutter hanger. When installed, the central cover portion 60 is desirably generally horizontal (substantially flat) with a small upward arch. The gutter cover is of a flexible, resilient sheet material (e.g., sheet metal, vinyl, or other plastic) having a thickness in the range of 0.010-0.045 in. and configured such that, when properly installed, the front and rear cover portions 62, 66 are resiliently urged against respective front and rear bends 38, 40 of the gutter hanger. This spring tension helps to secure the gutter cover in its properly installed position. The spring tension is created because the overall width of the gutter cover 10 in an unstressed condition (FIG. 1) is somewhat greater than (e.g., 0.25 in. greater than) the spacing between the front hanger portion 32 and the rear hanger portion 36 at the front and rear bends 38, 40 of the gutter hanger. As a result, the gutter cover must be squeezed widthwise during installation to assume a resiliently flexed condition in which the front and rear cover portions are resiliently urged against the gutter hanger at respective bends 38, 40, as illustrated in FIG. 3. By way of example but not limitation, the gutter cover may flex during installation an amount which reduces its overall unstressed width (e.g., five, six, or seven inches) by about 0.25 in. The reduction in width is accommodated by flex in various portions of the gutter cover, such as the rear cover portion 66 and the center cover portion 60.

Referring to FIG. 1, the central cover portion 60 is formed with a channel 68 running the length of the gutter cover 10. The channel 68 reinforces the central cover portion against sagging under the weight of water, snow, and debris. Further, the channel helps to keep the central cover portion substantially flat when the gutter cover is installed. In this regard, the flatter the central cover portion 60, the better the water flow. A substantially flat central cover portion results in a more even distribution (spread) of water over the gutter cover for a more efficient transfer of water to the front cover portion 62, thereby increasing the volume of water flowing into the gutter. In the illustrated embodiment, the channel 68 has the shape of a truncated V (a flat bottom and upwardly divergent side walls), but it may have other shapes (e.g., U, rectangular, V) without departing from the scope of this invention. The channel also has suitable dimensions. By way of example but not limitation, the channel may have depth in the range of 1/32-1/4 in., e.g., 1/16 in., and a width at the top of the channel in the range of 1/8-1.0 in., e.g., 3/8 in.

In the embodiment of FIGS. 1-3, the front cover portion 62 comprises an upper bend 70 integrally connecting the central cover portion 60 to the front cover portion, and a lower bend 74 below the upper bend. An upper leg 76 extends substantially linearly rearward and downward from the upper bend 70, and a lower leg 80 extends generally linearly forward and downward from the lower bend 74. In the embodiment of FIG. 1, the lower leg 80 has front section ("kicker") 82 which is bent down at steeper angle to provide extra strength when spanning the space between gutter hangers. The lower leg 80 terminates in a front edge 86 located forward of the upper bend 70. Desirably, this front edge 86 contacts the forward portion 32 of the gutter hanger 26 at the front bend 38 of the hanger when the gutter cover 10 is in its installed position (see FIG. 3). This contact spaces the front edge 86 of the gutter cover from the front wall 14 of the gutter 12 to provide a gap 88 at locations between the gutter hangers 26 through which water is able to drain down into the gutter.

The front cover portion 62 of the gutter cover 10 defines a channel 90 configured for receiving but not contacting the front flange 22 of the gutter 10, thus providing a continuous gap 92 between the front cover portion of the gutter cover and the front flange of the gutter for flow of water through the gap 92 down into the gutter 12. In the illustrated embodiment, the channel 90 and gap 92 are generally U-shaped, but they may have other configurations (e.g., V-shaped, rectangular, polygonal, or rounded). Desirably, the gap 92 has a width 94 in the range of 1/16-1/2 in., and even more desirably about 1/4 in., as measured horizontally between the front cover portion 62 and the end of the gutter flange 22 (see FIG. 3). The gap is maintained open and properly sized due to the engagement of the front and rear cover portions 62, 66 of the gutter cover with respective front and rear bends 38, 40 of the gutter hanger 26.

The front cover portion 62 includes a plurality of louver drains, each generally designated 100. In the embodiment of FIGS. 1-3, the louver drains 100 are located on the upper surface of the downwardly inclined lower leg 80 of the front cover portion. The louver drains 100 are spaced at intervals (e.g., regular intervals) along the length of the gutter cover 10. By way of example but not limitation, the distance D1 (FIG. 2) between adjacent louver drains 100 may be in the range of 1/8-1.0 in., e.g., about 3/8 in. The louver drains may be arranged in various ways, e.g., in a single row or alternately offset in front-to-back direction.

Each louver drain 100 comprises a drain opening 102 and a louver 104 for directing water through the drain opening into the gutter 12. The drain opening 102 is of suitable size. By way of example but not limitation, the drain opening 102 has a length L1 in the range of 1/16-1.0 in., e.g., about 9/16 in., and a width W1 in the range of 1/16-1.0 in., e.g., about 1/4 in. The louver 104 of each louver drain 100 comprises a raised arch-like structure 106 upset from the continuous sheet of the gutter cover. The louver structure 106 defines at least one open mouth 108 through which water can flow into the drain opening 102 of the louver drain 100. In the embodiment of FIGS. 1-3, the louver structure 106 defines two open mouths 108 at opposite sides of the louver structure. The first mouth faces in a generally rearward direction, and the second mouth faces in a generally forward direction. The open mouths 108 are of suitable size and shape. By way of example but not limitation, each mouth 108 may lie in a generally vertical plane and have a generally trapezoidal shape with a lower-end length corresponding to the length L1 of the corresponding drain opening 102 and a height H1 in the range of 1/16-3/4 in., e.g., 3/16 in.

The louver drains 100 perform two functions. First, they provide openings 102 in the front cover portion 62 for flow of water into gutter 12. Water flowing in a forward direction along the lower leg 108 flows either directly into the rearward-opening mouths 108 of the louvers 104 and then down through the drain openings 102 into the gutter, or through the spaces between adjacent louver drains 100. Water flowing through the spaces between the louver drains 100 will pass through the gap 88 at the front edge of the front cover portion 62 and drain into the gutter. If this latter flow is large, the water may back up and flow through the forward-opening mouths 108 of the louvers and then down through the drain openings 102 into the gutter, thus increasing the capacity of water flow that can be handled by the gutter cover.

The second function of the louver drains 100 is to keep the front cover portion 62 of the gutter in its properly installed position. In this regard, the height of the raised louvers 104 is such that when the gutter cover is properly installed, as illustrated in FIG. 3, there is only a relatively small vertical gap 110 between the tops of the louver structures 106 and the gutter flange 22 to limit uplift of the gutter cover from its properly installed position due to wind and other unintended causes. Desirably, the gap 110 is in the range of 0.0-0.50 in., and desirably about 1/16 in. As a result, if forces are applied to the gutter cover 10 tending to lift is out of its installed position, the raised louvers 104 of the louver drains will contact the gutter flange 22 and limit upward movement of the front cover portion to an extent sufficient to maintain the proper gap 92 between the front cover portion 62 and the gutter flange 22 to insure efficient flow of water down past the flange 22 and into the gutter. Without the raised louvers 104, the front cover portion 62 would be free to move up into contact with the flange 22, thus closing the gap 92 and restricting the flow of water into the gutter.

In the illustrated embodiment, the rear cover portion 66 of the gutter cover 10 is configured to extend down at an angle A relative to the central cover portion 60. Desirably, this angle is greater than 90 degrees, and is preferably in the range of 90-120 degrees. Optionally, the rear cover portion 60 has a lower end section (not shown) bent at a steeper angle to provide a "kicker" for added strength when spanning the space between the gutter hangers 26. (This "kicker" feature is illustrated at 290 in the embodiment of FIG. 8.) When the gutter cover is installed, as illustrated in FIG. 3, the lower end of the rear cover portion 66 is disposed below the head of the fastener 50 and positioned for engagement with the fastener to limit uplift of the rear cover portion. In other embodiments, the rear cover portion 60 may be a generally flat extension of the central cover portion 60 for fitting under shingles on the roof 28, as described for example in my U.S. Pat. No. 7,650,720 incorporated herein by reference. Alternatively, the rear cover portion 60 may have multiple bends, as described for example in FIGS. 15 and 16 of my U.S. Pat. No. 7,891,142 and in my U.S. Pat. Nos. 8,402,697 and D683,827, all of which are incorporated herein by reference.

By way of example but not limitation, the central, front, and rear portions 60, 62, 66 of the gutter cover 10 may be formed by subjecting a blank of sheet material (e.g., sheet metal) to a roll forming operation, and the louver drains 100 may be formed by subjecting the sheet material to a punching operation during which material punched from the sheet to form the drain openings 102 is upset to form the raised louvers 104. The gutter cover may be formed in other ways.

The gutter cover 10 described above is easy to install. The front and rear cover portions 62, 66 are simply resiliently squeezed toward one and then positioned such that the lower leg 80 of the front cover portion is below the gutter flange 22 and in contact with the central hanger portion 30 of each gutter hanger 26 adjacent the front bend 38 of the hanger, and the lower end of the rear cover portion 66 is in contact with each gutter hanger adjacent the rear bend 40 of the hanger below the head of the fastener 50. When the squeezing force on the gutter cover 10 is released, the spring tension in the gutter cover urges the front cover portion 62 into pressure contact with the forward portion 32 of each gutter hanger 26 at the front bend 38 of the hanger, and the rear cover portion 66 into pressure contact with the rear portion 36 of each gutter hanger 26 at the rear bend 40 of the hanger, as illustrated in FIG. 3. As described earlier, this pressure contact helps to maintain the gutter cover 10 in its properly installed position. Further, the relatively small vertical gap 110 between the tops of the louver structures 106 and the gutter flange 22 limits unintended uplift of the gutter cover from its properly installed position to maintain open the gap 92 through which water flows between the front cover portion 62 and the gutter flange 22.

Figure 4:
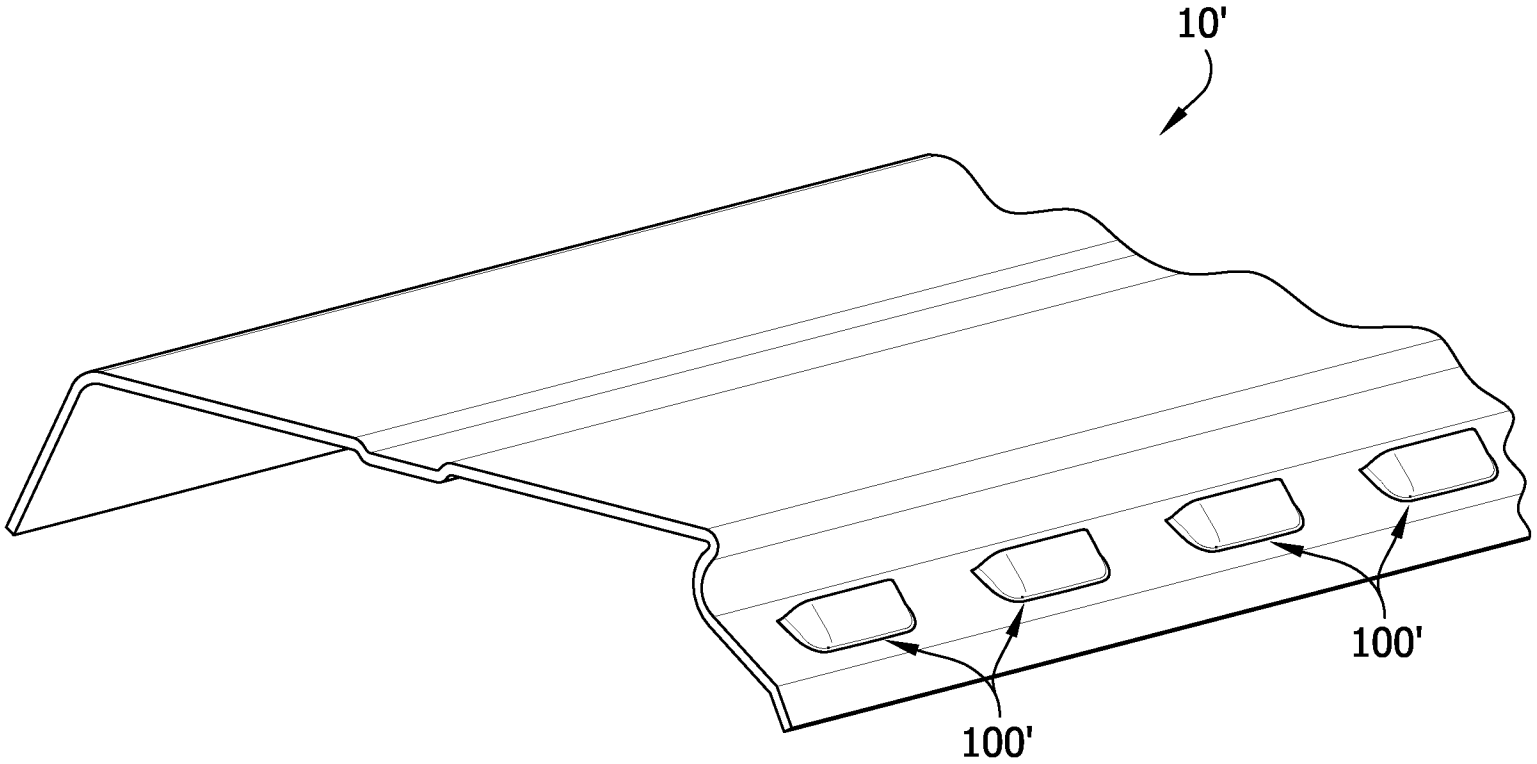
FIG. 4 is a perspective view of a second embodiment of a gutter cover of this invention.
Figure 5:
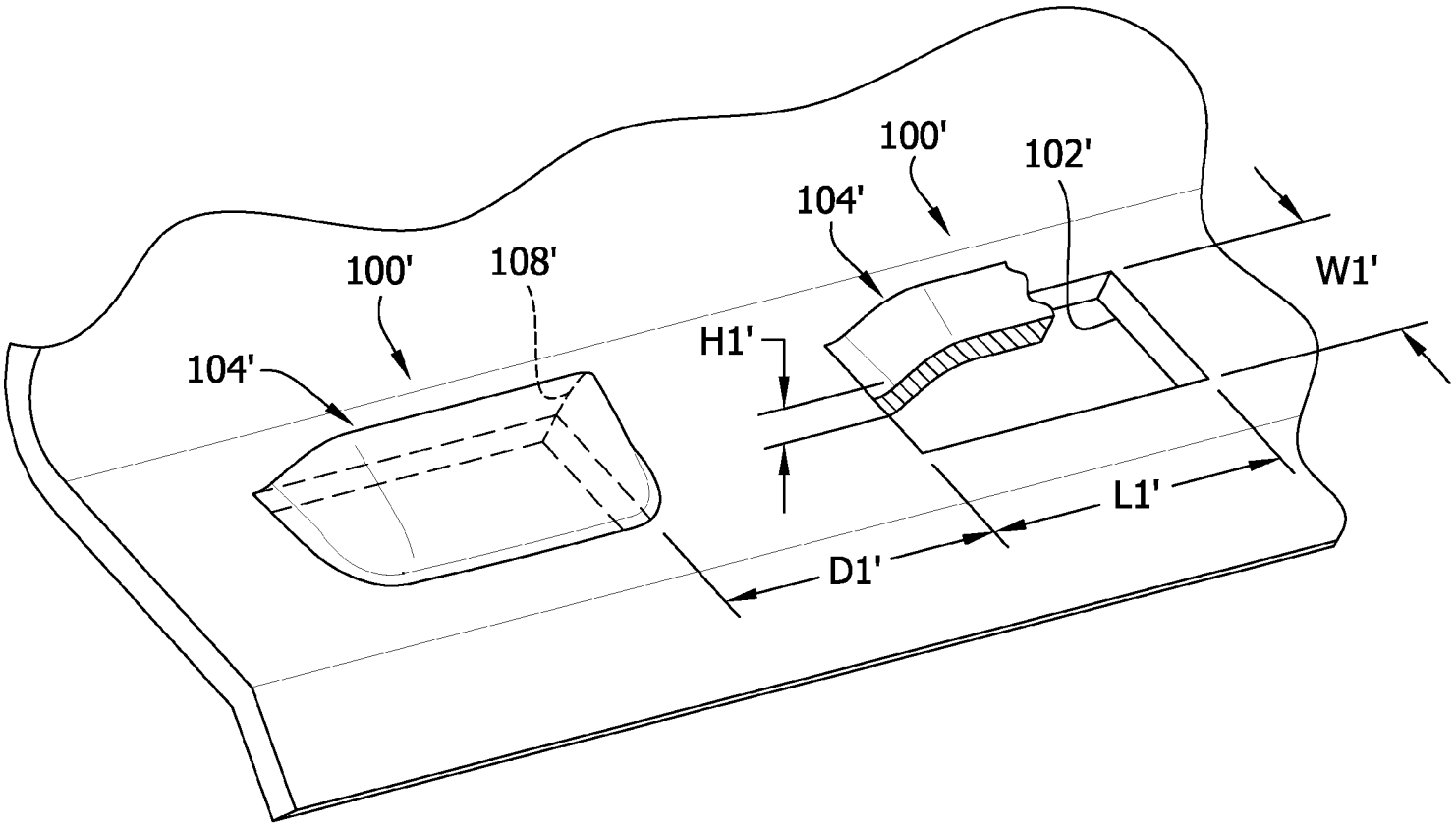
FIG. 5 is an enlarged portion of FIG. 4 showing louver drains of the gutter cover, portions of one louver drain being broken away to show details of a drain opening.

FIGS. 4 and 5 illustrate a second embodiment of the gutter cover, generally designated 10'. The gutter cover is similar to the gutter cover 10 of the first embodiment, and corresponding parts are designated by corresponding reference numbers with the addition of a prime (') designator. The only difference between the two embodiments is that in the second embodiment the louver 104' of each louver drain 100' has only one open mouth 108' facing in a generally rearward direction. The opposite side of the louver 104' is closed, such that the louver structure 106' has a generally concave configuration. The louver drains 100' of the gutter cover 10' may have dimensions L1', W1', H1', D1' substantially the same as the corresponding dimensions L1, W1, H1, D1 of the louver drains 100 of the gutter cover 10.

Figure 6:
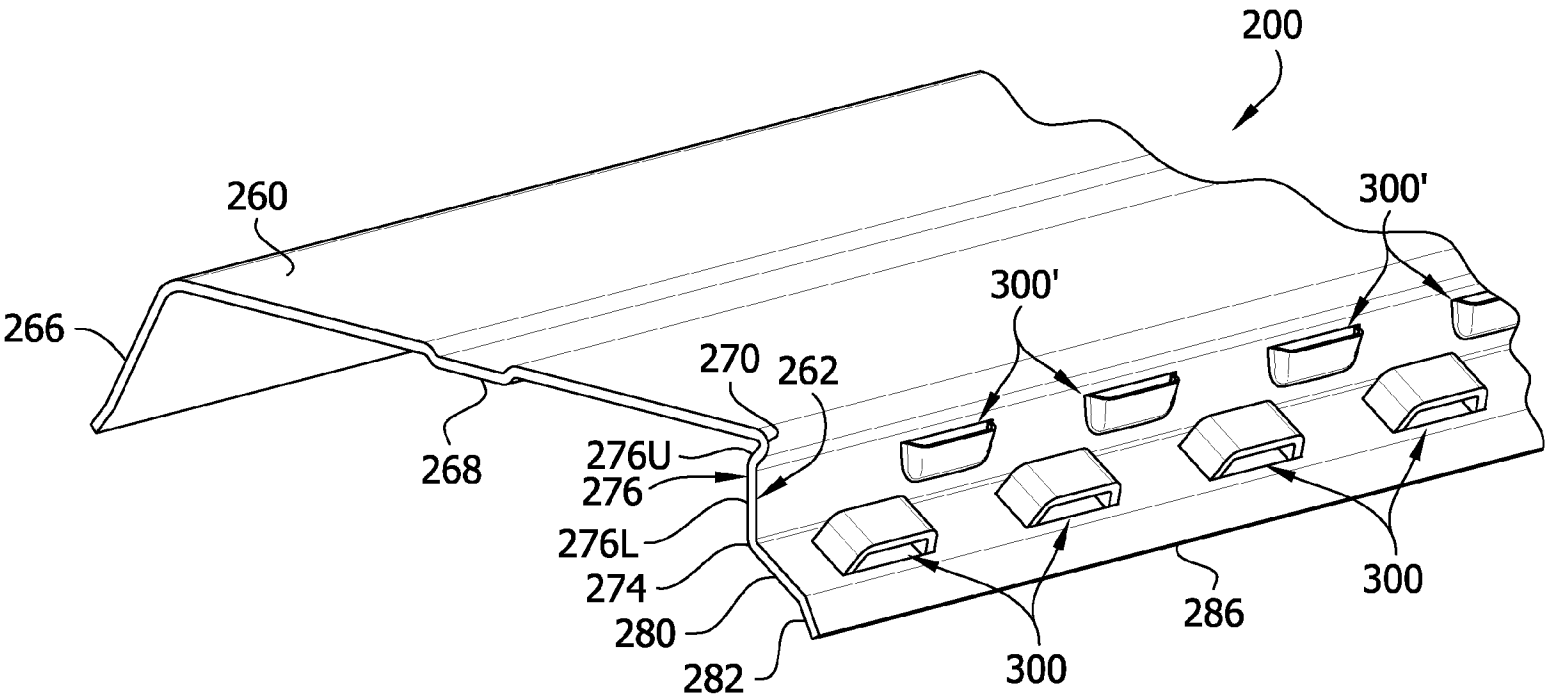
FIG. 6 is a perspective view of a third embodiment of a gutter cover of this invention.
Figure 7:
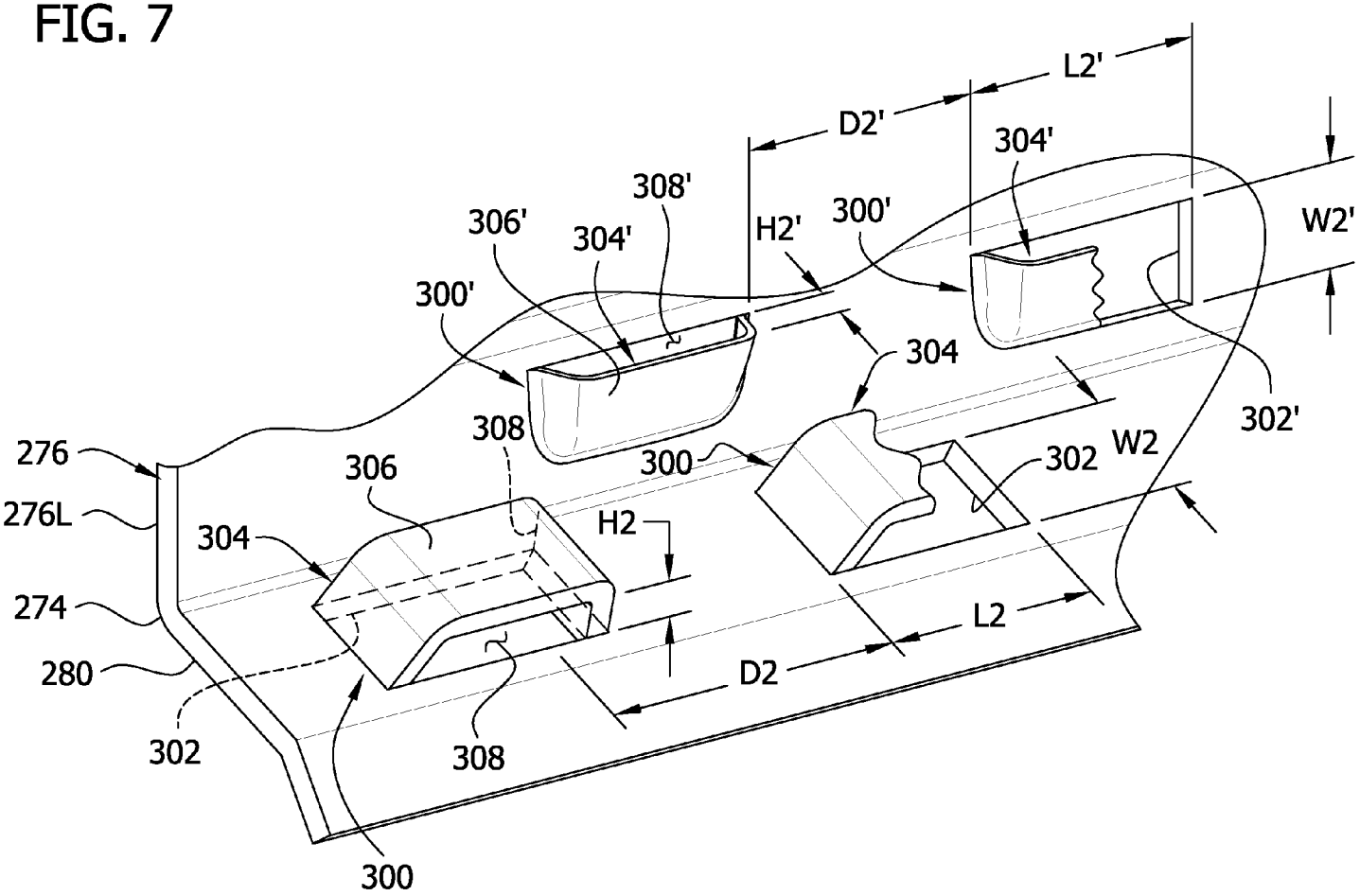
FIG. 7 is an enlarged portion of FIG. 7 showing louver drains of the gutter cover, portions of two louver drains being broken away to show details of a drain opening.
Figure 8:
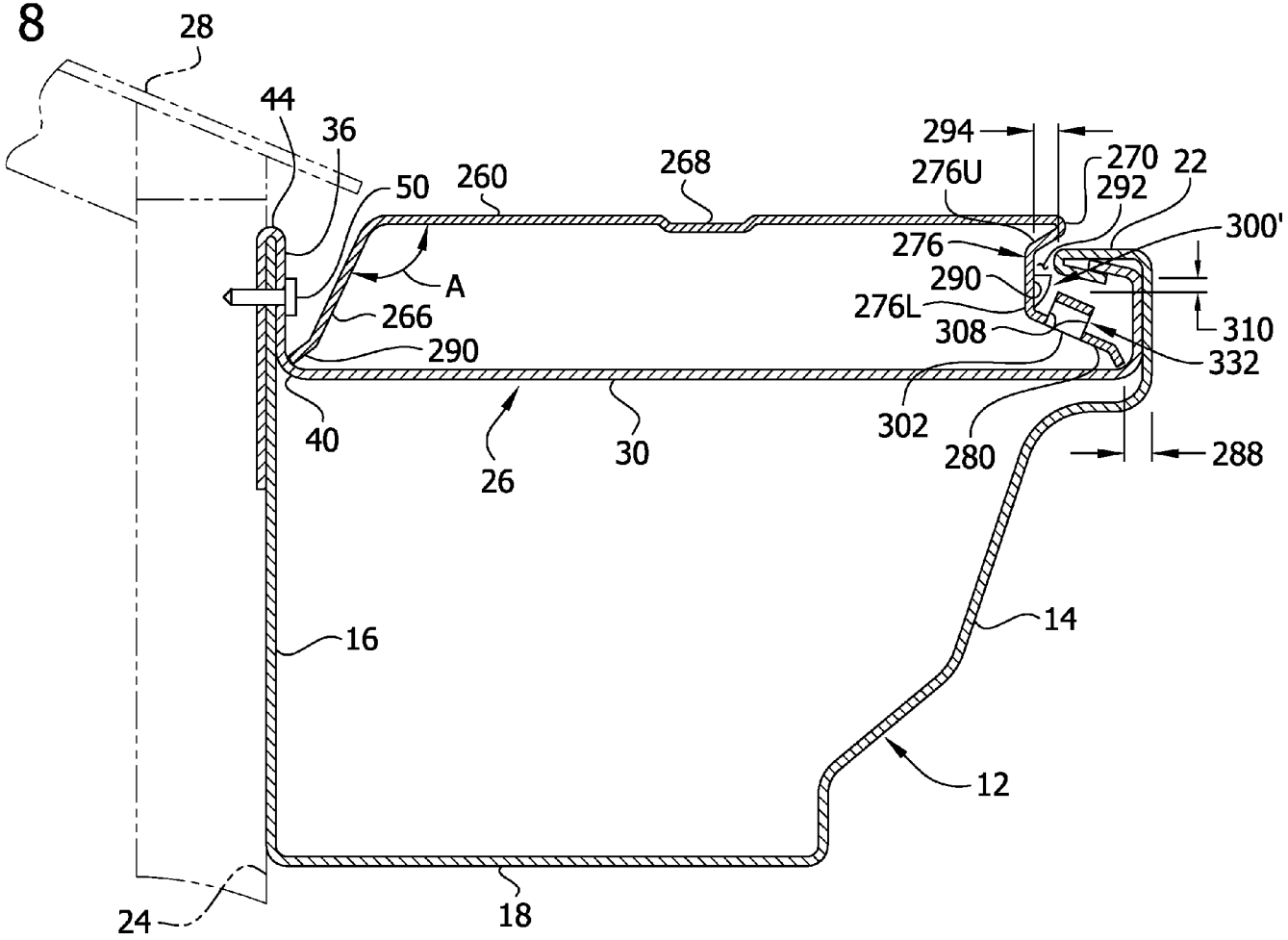
FIG. 8 is a transverse cross-sectional view of the gutter cover of FIG. 6 as installed on a gutter.

FIGS. 6-8 illustrate a third embodiment of a gutter cover of my invention, generally designated 200. The gutter cover 200 is shown in a properly installed position on the rain gutter 12 supported by the hangers 26 described above.

The gutter cover 200 is similar to the gutter cover 10 of the first embodiment in that it comprises an elongate sheet of substantially continuous non-perforated. In its installed position, the cover 200 has a generally horizontal central cover portion 260, a front cover portion 262 formed integrally with the central cover portion and configured to extend downward to contact the front portion 32 of the gutter hanger at the front bend 38 of the hanger, and a rear cover portion 266 formed integrally with the central portion 260 and configured to extend downward to contact the rear portion of the gutter hanger at the rear bend 40 of the gutter hanger. The gutter cover is of a flexible, resilient material (e.g., metal, vinyl, or other plastic) and configured such that the front and rear cover portions 262, 266 are resiliently urged against respective front and rear bends 38, 40 of the gutter hanger to secure the gutter cover in its properly installed position. This spring tension helps to secure the gutter cover in its properly installed position. The spring tension is created because the overall width of the gutter cover 200 in an unstressed condition (FIG. 6) is somewhat greater than (e.g., 0.25 in. greater than) the spacing between the front hanger portion 32 and the rear hanger portion 36 at the front and rear bends 38, 40 of the gutter hanger. As a result, the gutter cover must be squeezed widthwise during installation to assume a resiliently flexed condition in which the front and rear cover portions 262, 266 are resiliently urged against the gutter hanger at respective bends 38, 40, as illustrated in FIG. 8. By way of example but not limitation, the gutter cover 200 may flex during installation an amount which reduces its overall unstressed width (e.g., five, six, or seven inches) by about 0.25 in. The reduction in width is accommodated by flex in various portions of the gutter cover, such as the rear cover portion 266 and the center cover portion 260.

Referring to FIG. 6, the central cover portion 260 is formed with a channel 268 running the length of the gutter cover 200. The channel 268 reinforces the central cover portion against sagging under the weight of water, snow, and debris. Further, the channel helps to keep the central cover portion substantially flat when the gutter cover is installed. In this regard, the flatter the central cover portion 260, the better the water flow. A substantially flat central cover portion results in a more even distribution (spread) of water over the gutter cover for a more efficient transfer of water to the front cover portion 262, thereby increasing the volume of water flowing into the gutter. In the illustrated embodiment, the channel 268 has a flat bottom and upwardly divergent side walls, but it may have other shapes without departing from the scope of this invention. The channel also has suitable dimensions. By way of example but not limitation, the channel may have depth in the range of 1/32-1/4 in., e.g., 1/16 in., and a width at the top of the channel in the range of 1/8-1.0 in., e.g., 3/8 in.

The front cover portion 262 comprises an upper bend 270 integrally connecting the central cover portion 260 to the front cover portion, and a lower bend 274 below the upper bend. An upper leg 276 extends substantially rearward and downward from the upper bend 270, and a lower leg 280 extends generally linearly forward and downward from the lower bend 274. In the embodiment of FIGS. 6-8, the upper leg 276 comprises a substantially linear upper section 276U sloping downward and rearward from the upper bend 270 and a substantially linear lower section 276L extending generally vertically down from the upper section 276U. The lower leg 280 has front section ("kicker") 282 which is bent down at steeper angle. The lower leg 280 terminates in a front edge 286 located forward of the upper bend 270. Desirably, this front edge 286 contacts the forward portion 32 of the gutter hanger 26 at the front bend 38 of the hanger when the gutter cover 200 is in its properly installed position (see FIG. 8).

Referring to FIG. 8, the front cover portion 262 of the gutter cover 10 defines a channel 290 configured for receiving but not contacting the front flange 22 of the gutter 10, thus providing a continuous gap 292 between the front cover portion of the gutter cover and the front flange of the gutter for flow of water through the gap down into the gutter 12. In the illustrated embodiment, the channel 290 and gap 292 has the general shape of a truncated V, but it may have other configurations (e.g., U-shaped, rectangular, polygonal, or rounded). Desirably, the gap 292 has a width 294 in the range of 1/16-1/2 in., and even more desirably about 1/8 in., as measured horizontally between the front cover portion 62 and the end of the gutter flange 22 (see FIG. 3). The gap 292 is maintained open and at the proper predetermined width due to the engagement of the front and rear cover portions 262, 266 of the gutter cover with respective front and rear bends 38, 40 of the gutter hanger 26.

The front cover portion 262 of the gutter cover 200 of this embodiment has first and second sets of louver drains, each louver drain of the first set being generally designated 300 and each louver drain of the second set being generally designated 300'. The louver drains 300 of the first set are formed on the lower leg 280 of the front cover portion, like the gutter cover 10 of the first embodiment, and the louver drains 300' of the second set are formed on the upper leg of the front cover portion 262. Desirably, the louver drains 300' are formed on the lower generally vertical section 276L of the upper leg 276.

In general, each louver drain 300 on the lower leg 280 of the front cover portion 62 has the same components as the louver drain 100 described earlier, namely, a drain opening 302 and a raised louver 304 above the drain opening. The drain opening 302 is of suitable size. By way of example but not limitation, the drain opening 302 has a length L2 in the range of 1/16-1.0 in., e.g., about 9/16 in., and a width W2 in the range of 1/16-1.0 in., e.g., about 1/4 in. The louver 304 of each louver drain 300 comprises a raised arch-like structure 306 upset from the continuous sheet of the gutter cover. The louver structure 306 defines at least one mouth 308 through which water can flow into the drain opening 302 of the louver drain 300. In the embodiment of FIGS. 6-8, the louver structure 306 defines two open mouths 308 at opposite sides of the louver structure. The first mouth faces in a generally rearward direction, and the second mouth faces in a generally forward direction. The open mouths 308 are of suitable size and shape. By way of example but not limitation, each mouth 108 may lie in a generally vertical plane and have a generally trapezoidal shape with a lower-end horizontal length corresponding to the length L2 of the corresponding drain opening 102 and a vertical height H2 in the range of 1/16-3/4 in., e.g., about 3/16 in.

In the embodiment of FIGS. 6-8, the louver drains 300 are spaced at intervals (e.g., regular intervals) along the length of the gutter cover 200. By way of example but not limitation, the distance D2 (FIG. 7) between adjacent louver drains 300 may be in the range of 1/8-1.0 in., e.g., about 3/8 in. The louver drains may be arranged in various ways, e.g., in a single row or alternately offset in front-to-back direction.

Optionally, the louver drains 300 of the gutter cover 200 may be replaced with louver drains like the louver drains 100' of the second embodiment. That is, each louver drain 300 may be replaced with a louver drain having only one open mouth, facing rearward, instead of two open mouths.

In general, each louver drain 300' on the lower generally vertical section 276L of the upper leg 276 of the front cover portion 262 comprises a drain opening 302' and a raised louver 304' overlying the drain opening. The drain opening 302' is of suitable size. By way of example but not limitation, the drain opening 302' has a horizontal length L2' in the range of 1/16-1.0 in., e.g., about 9/16 in., and a vertical width W2' in the range of 1/16-1.0 in., e.g., about 1/4 in. The louver 304' of each louver drain 300' comprises a raised structure 306' upset from the continuous sheet of the gutter cover. The louver structure 306' defines a single (only one) open mouth 308' at the upper side of the louver 304'. The opposite lower side of the louver structure 306' is closed such that the louver structure has a generally concave shape. The open mouth 308' faces upward for catching water and directing it into the drain opening 302' of the louver drain 300'. The open mouth 308' is of suitable size and shape. By way of example but not limitation, the mouth 308' may lie in a generally horizontal plane and have a generally rectangular shape with a horizontal length corresponding to the length L2' of the corresponding drain opening 302' and a horizontal width H2' in the range of 1/16-3/4 in., e.g., about 3/16 in.

In the embodiment of FIGS. 6-8, the louver drains 300' are spaced at intervals (e.g., regular intervals) along the length of the gutter cover 200. By way of example but not limitation, the distance D2' between adjacent louver drains 300 may be in the range of 1/8-1.0 in., e.g., about 3/8 in. The louver drains may be arranged in various ways, e.g., in a single generally horizontal row or alternately offset in a vertical direction.

The louver drains 300, 300' permit water to flow into the gutter 12. Providing two sets of louver drains 300, 300' increases the water flow capacity of the gutter cover 200. The louver drains 300 also function to keep the front cover portion 262 of the gutter in its properly installed position. In this regard, the height of the raised louvers 304 is such that when the gutter cover is properly installed, as illustrated in FIG. 8, there is only a relatively small vertical gap 310 between the tops of the louver structures 306 and the gutter flange 22 to limit unintended uplift of the gutter cover from its properly installed position. Desirably, this gap is in the range of 0.0-0.50 in., and desirably about 1/16 in. As a result, if forces are applied to the gutter cover 10 tending to lift is out of its installed position, the raised louvers 304 of the louver drains 300 will contact the gutter flange 22 and thus limit upward movement of the front cover portion to an extent sufficient to maintain the proper gap 262 between the front cover portion 262 and the gutter flange 22 for efficient flow of water down past the flange 22 and into the gutter. Without the raised louvers 304, the front cover portion 62 would be free to move up into contact with the flange 22 and thus close the gap 92 and restrict the flow of water into the gutter.

Optionally, the louvers 304' of the louver drains 300' on the upper leg 276 may also be configured to contact the gutter flange 22 and thus limit the extent of any upward movement of the front cover portion.

In the illustrated embodiment, the rear cover portion 266 of the gutter cover 10 is configured to extend down at an angle A relative to the central cover portion 260. Desirably, this angle is greater than 90 degrees, and is preferably in the range of 90-120 degrees. Optionally, the rear cover portion 260 has a lower end section 290 bent at a steeper angle to provide a "kicker" for added strength when spanning the space between the gutter hangers 26. In other embodiments, the rear cover portion 266 may be a generally flat extension of the central cover portion 260 for fitting under shingles on the roof 28, as described for example in my U.S. Pat. No. 7,650,720 incorporated herein by reference. Alternatively, the rear cover portion 60 may have multiple bends, as described for example in FIGS. 15 and 16 of my U.S. Pat. No. 7,891,142 and in my U.S. Pat. Nos. 8,402,697 and D683,827, all of which are incorporated herein by reference.

The gutter cover 200 described above is easy to install. The front and rear cover portions 262, 266 are simply resiliently squeezed toward one and then positioned such that the lower leg 280 of the front cover portion is below the gutter flange 22 and in contact with the central hanger portion 30 of the gutter hanger 26 adjacent the front bend 38 of the hanger, and the lower end of the rear cover portion 266 is in contact with the gutter hanger adjacent the rear bend 40 of the hanger. When the squeezing force on the gutter cover 200 is released, the spring tension in the gutter cover urges the front cover portion 262 into pressure contact with the forward portion 32 of the gutter hanger 26 at the front bend 38 of the hanger, and the rear cover portion 266 into pressure contact with the rear portion 36 of the gutter hanger 26 at the rear bend 40 of the hanger below the head of the fastener 50, as illustrated in FIG. 8. As described earlier, this pressure contact helps to maintain the gutter cover 10 in its properly installed position. Further, the relatively small vertical gap 110 between the raised louver structures 106 and the gutter flange 22 limits unintended uplift of the gutter cover from its properly installed position to keep open the gap 292 between the front cover portion 262 and the gutter flange 22.

By way of example but not limitation, the central, front, and rear portions 260, 262, 266 of the gutter cover 10 may be formed by subjecting a blank of sheet material (e.g., sheet metal) to a roll forming operation, and the louver drains 300 may be formed by subjecting the sheet material to a punching operation during which material punched from the sheet to form the drain openings 302, 302' is upset to form the louvers 304, 304'. The gutter cover may be formed in other ways.

Figure 9:
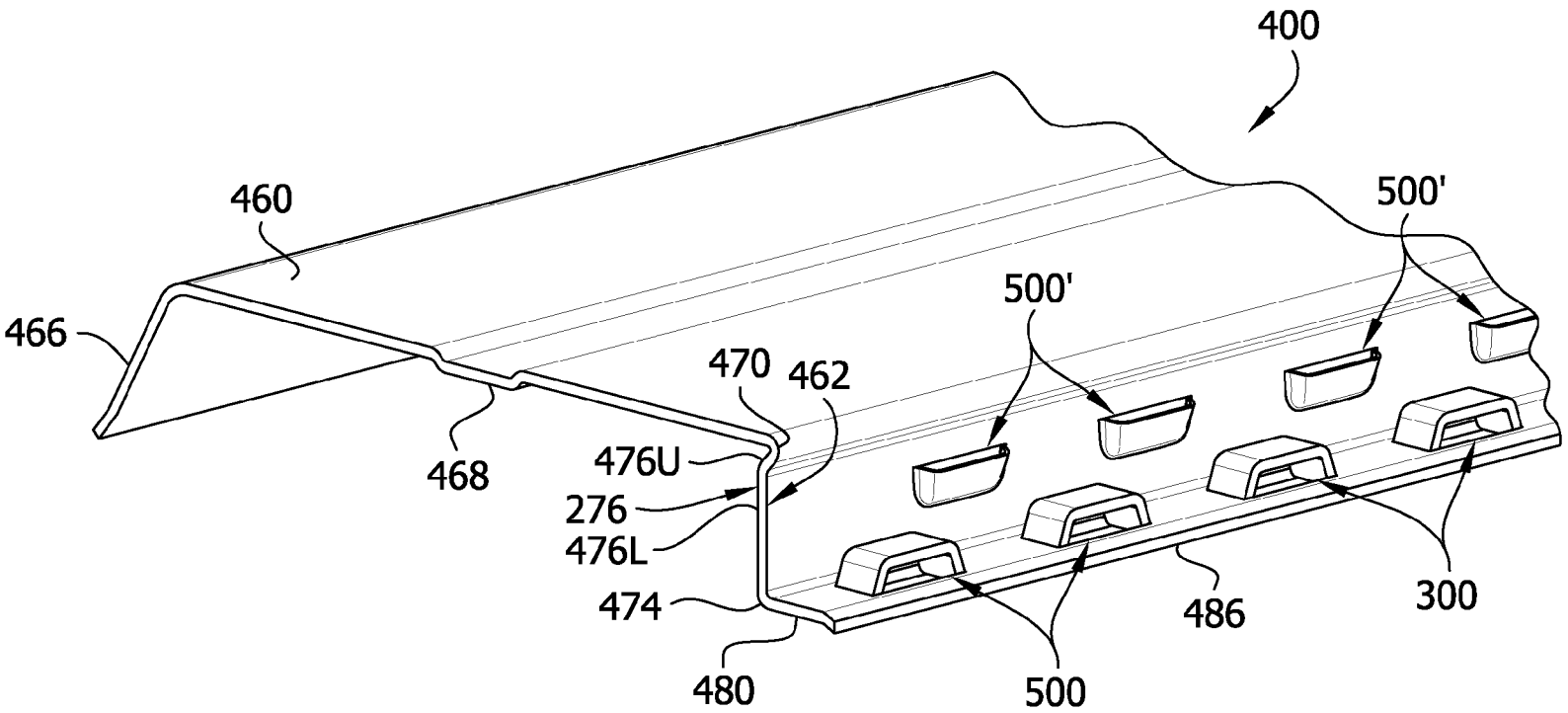
FIG. 9 is a perspective view of a fourth embodiment of a gutter cover of this invention.
Figure 10:
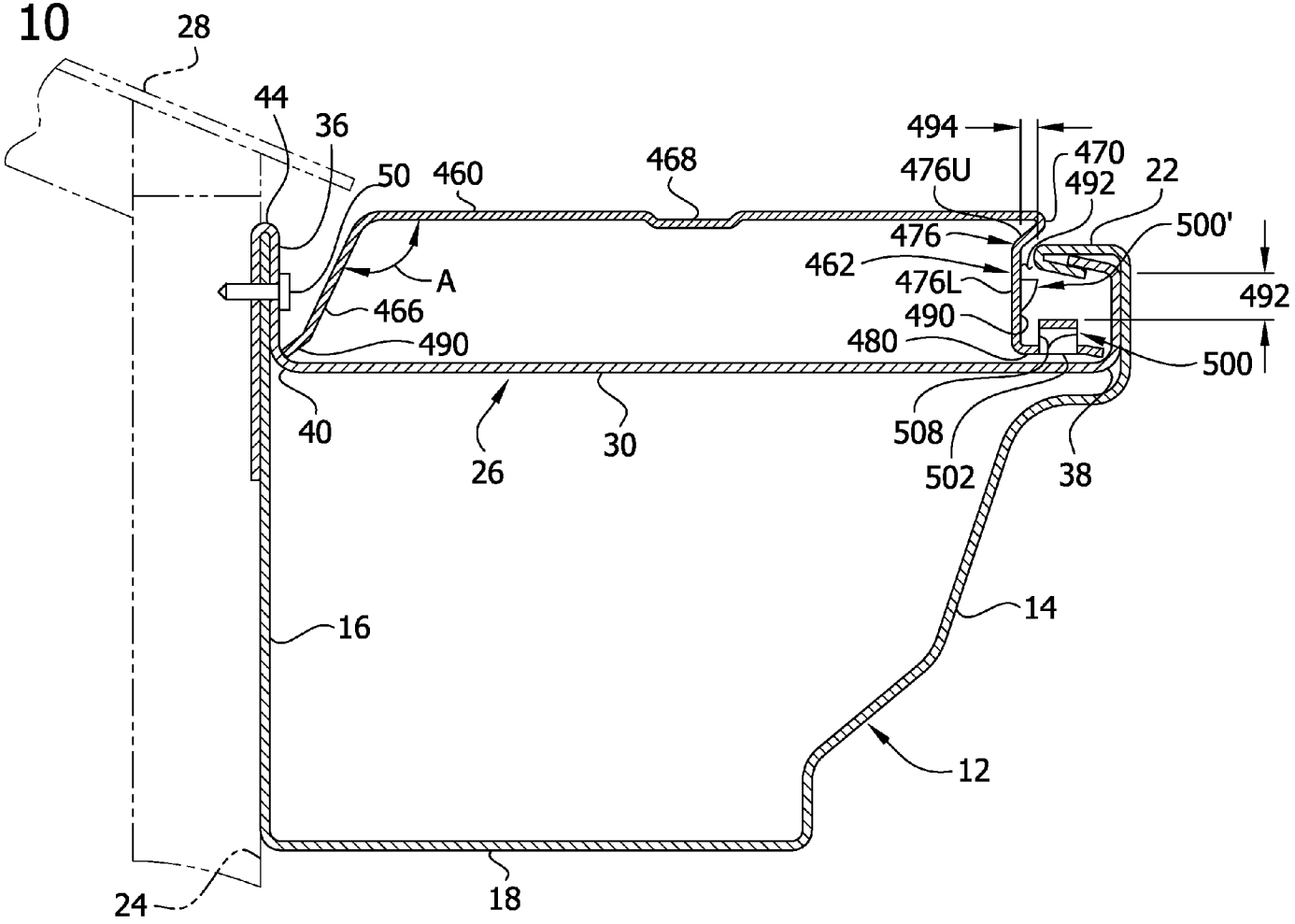
FIG. 10 is a transverse cross-sectional view of the gutter cover of FIG. 9 as installed on a gutter.

FIGS. 9 and 10 illustrate a fourth embodiment of a gutter cover of my invention, generally designated 400. The gutter cover 400 is shown in a properly installed position on the rain gutter 12 supported by the hangers 26 described above.

The gutter cover 400 is similar to the gutter cover 10 of the second embodiment in that it comprises an elongate sheet of substantially continuous non-perforated. In its installed position, the cover 400 has a generally horizontal central cover portion 460, a front cover portion 462 formed integrally with the central cover portion and configured to extend downward to contact the front portion 32 of the gutter hanger at the front bend 38 of the hanger, and a rear cover portion 466 formed integrally with the central portion 460 and bent downward to contact the rear portion 36 of the gutter hanger at the rear bend 40 of the gutter hanger. The gutter cover is of a flexible, resilient material (e.g., metal, vinyl, or other plastic) and configured such that the front and rear cover portions 462, 466 are resiliently urged against respective front and rear bends 38, 40 of the gutter hanger to secure the gutter cover in its properly installed position. This spring tension helps to secure the gutter cover in its properly installed position. The spring tension is created because the overall width of the gutter cover 400 in an unstressed condition (FIG. 9) is somewhat greater than (e.g., 0.25 in. greater than) the spacing between the front hanger portion 32 and the rear hanger portion 36 at the front and rear bends 38, 40 of the gutter hanger. As a result, the gutter cover must be squeezed widthwise during installation to assume a resiliently flexed condition in which the front and rear cover portions 462, 466 are resiliently urged against the gutter hanger at respective bends 38, 40, as illustrated in FIG. 10. By way of example but not limitation, the gutter cover 400 may flex during installation an amount which reduces its overall unstressed width (e.g., five, six, or seven inches) by about 0.25 in. The reduction in width is accommodated by flex in various portions of the gutter cover, such as the rear cover portion 466 and the center cover portion 460.

Referring to both FIGS. 9 and 10, the central cover portion 460 is formed with a channel 468 running the length of the gutter cover 400. The channel 468 reinforces the central cover portion against sagging under the weight of water, snow, and debris. Further, the channel helps to keep the central cover portion substantially flat when the gutter cover is installed. In this regard, the flatter the central cover portion 460, the better the water flow. A substantially flat central cover portion results in a more even distribution (spread) of water over the gutter cover for a more efficient transfer of water to the front cover portion 462, thereby increasing the volume of water flowing into the gutter. In the illustrated embodiment, the channel 468 has a flat bottom and upwardly divergent side walls, but it may have other shapes without departing from the scope of this invention. The channel also has suitable dimensions. By way of example but not limitation, the channel may have depth in the range of 1/32-1/4 in., e.g., 1/16 in., and a width at the top of the channel in the range of 1/8-1.0 in., e.g., 3/8 in.

The front cover portion 462 comprises an upper bend 470 integrally connecting the central cover portion 460 to the front cover portion, and a lower bend 474 below the upper bend. An upper leg 476 extends substantially rearward and downward from the upper bend 470, and a lower leg 480 extends generally horizontally forward from the lower bend 474. Desirably, substantially the entire length of the lower leg 480 rests on the central hanger portion 30. This configuration provides additional support for the gutter cover 400 and increases its debris-load capacity, i.e., the capacity of the gutter cover to support debris without collapsing. In this embodiment, the upper leg 476 comprises a substantially linear upper section 476U sloping downward and rearward from the upper bend 470 and a substantially linear lower section 476L extending generally vertically down from the upper section 476U. (This lower section 476L is longer than the lower section 376L of the third embodiment.) The lower leg 480 terminates in a front edge 486 located forward of the upper bend 470. Desirably, this front edge 486 contacts the forward portion 32 of the gutter hanger 26 at the front bend 38 of the hanger when the gutter cover 400 is in its installed position (see FIG. 10).

The front cover portion 462 defines a channel 490 configured for receiving but not contacting the front flange 22 of the gutter 10, thus providing a continuous gap 492 between the front cover portion of the gutter cover and the front flange of the gutter for flow of water through the gap down into the gutter 12. In the illustrated embodiment, the channel 490 and gap 492 are generally C-shaped, but they may have other configurations (e.g., U-shaped, rectangular, polygonal, or rounded). Desirably, the gap 492 has a width 494 in the range of 1/16-1/2 in., and even more desirably about 1/8 in., as measured horizontally between the front cover portion 62 and the end of the gutter flange 22 (see FIG. 3). The gap 492 is maintained open and properly sized due to the engagement of the front and rear cover portions 462, 466 of the gutter cover with respective front and rear bends 38, 40 of the gutter hanger 26.

Like the gutter cover 200 described above, the front cover portion 462 of the gutter cover 400 has first and second sets of louver drains, each louver drain of the first set being generally designated 500, and each louver drain of the second set being generally designated 500'. The louver drains 500 of the first set are formed on the lower leg 480 of the front cover portion 462, like the louver drains 300 of the gutter cover 200 of the third embodiment, and the louver drains 500' of the second set are formed on the lower section 476L of the upper leg 476 of the front cover portion 462, like the louver drains 300' of the third embodiment.

In general, the louver drains 500, 500' of the gutter cover 400 are essentially identical in configuration and function as the louver drains 300, 300' of the gutter cover 200, so that further description is unnecessary.

Optionally, the louver drains 500 of the gutter cover 400 may be replaced with louver drains like the louver drains 100' of the second embodiment. That is, each louver drain 500 may be replaced with a louver drain having only one open mouth, facing rearward, instead of two open mouths.

Referring to FIG. 10, the rear cover portion 466 of the gutter cover 400 is configured to extend down at an angle A relative to the central cover portion 460. Desirably, this angle is greater than 90 degrees, and is preferably in the range of 90-120 degrees. Optionally, the rear cover portion 460 has a lower end section 490 bent at a steeper angle to provide a "kicker" for added strength when spanning the space between the gutter hangers 26. In other embodiments, the rear cover portion 466 may be replaced by a generally flat extension of the central cover portion 460 for fitting under shingles on the roof 28, as described for example in my U.S. Pat. No. 7,650,720 incorporated herein by reference. Alternatively, the rear cover portion 466 may have multiple bends, as described for example in FIGS. 15 and 16 of my U.S. Pat. No. 7,891,142 and in my U.S. Pat. Nos. 8,402,697 and D683,827, all of which are incorporated herein by reference.

The gutter cover 400 is installed in essentially the same manner as the gutter cover 200 described above. The only difference is that, during installation, the front gutter portion 462 is moved to the position shown in FIG. 10 in which substantially the entire length of the generally horizontal lower leg 480 is substantially parallel to and immediately above the generally horizontal central portion of gutter hanger 26 to increase the debris-load capacity of the gutter cover.

By way of example but not limitation, the central, front, and rear portions 460, 462, 466 of the gutter cover 400 may be formed by subjecting a blank of sheet material (e.g., sheet metal) to a roll forming operation, and the louver drains 500, 500' may be formed by subjecting the sheet material to a punching operation during which material punched from the sheet to form the drain openings is upset to form the louver structures. The gutter cover may be formed in other ways.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. Further, all dimensional information set forth herein is exemplary only and is not intended to limit the scope of the invention. It is understood that any of the particular embodiments of the present invention may include one or more of the aspects or features of the invention as described herein and illustrated in the drawings.

What is claimed is:

1. An elongate gutter cover for covering a gutter supported by a gutter hanger, the gutter having a front wall, a back wall, a bottom wall, and a flange projecting rearward from the front wall and spaced above the bottom wall of the gutter, the gutter cover comprising a central cover portion configured to overlie the gutter when the gutter cover is in an installed position on the gutter, and a front cover portion formed integrally with the central cover portion and configured to extend downward to a location below the gutter flange when the gutter cover is in said installed position, said front cover portion including a plurality of louver drains, each louver drain of said plurality of louver drains comprising a drain opening and a raised louver above the drain opening, wherein each raised louver of said plurality of louver drains comprises an arch-like structure upset from the continuous sheet to form a respective drain opening below the arch-like structure, said arch-like structure defining at least one open mouth through which water can flow into the draining opening of the louver drain, and wherein the front cover portion of the gutter cover is bent to define a channel configured for receiving but not contacting the front flange of the gutter to provide a continuous gap between the forward cover portion of the gutter cover and the front flange of the gutter for flow of water through the gap to said louver drains when the gutter cover is in said installed position.

2. The gutter cover of claim 1, wherein the louver drains of said plurality of louver drains are positioned below the gutter flange when the gutter cover is in said installed position, and wherein the raised louvers of the plurality of louver drains are positioned to contact the gutter flange to limit uplift of the front cover portion of the gutter cover away from said installed position.

3. The gutter cover of claim 1, wherein the at least one open mouth of the arch-like structure faces generally rearward.

4. The gutter cover of claim 1, wherein said arch-like structure defines first and second open mouths facing in substantially opposite directions.

5. The gutter cover of claim 1, further comprising a rear cover portion formed integrally with the central cover portion and configured to extend downward to contact a rear bend of the gutter hanger, and wherein the gutter cover is configured such that said front and rear cover portions of the gutter cover are resiliently urged against respective front and rear portions of the gutter hanger when the gutter cover is in said installed position.

6. The gutter cover of claim 1, wherein said front cover portion comprises an upper bend integrally connecting the central cover portion to the front cover portion, a lower bend below the upper bend, an upper leg extending downward from the upper bend, and a lower leg extending forward from the lower bend, the lower leg terminating in a front edge located forward of the upper bend.

7. The gutter cover of claim 6, wherein the gutter hanger comprises a front bend connecting a central hanger portion and a front hanger portion, and wherein the lower leg extends generally horizontally for contact along a substantial length of the lower leg with said central hanger portion.

8. The gutter cover of claim 6, wherein at least some of the louver drains are on the lower leg.

9. The gutter cover of claim 6, wherein at least some of the louver drains are on the upper leg.

10. The gutter cover of claim 6, wherein the louver drains are on the upper and lower legs.

11. The gutter cover of claim 1, further comprising a channel in the central cover portion running substantially the full length of the gutter cover.

12. The gutter cover of claim 1, wherein the central cover portion and the front cover portion are of sheet metal, and wherein the at least one open mouth is located at one side of the arch-like structure above the drain opening of a respective louver drain.

13. A gutter system comprising an elongate gutter having front, back and bottom walls and a flange projecting rearward from the front wall and spaced above the bottom wall of the gutter, a hanger supporting the gutter, the hanger having a central hanger portion, a front hanger portion extending up from the central hanger portion to a location below the gutter flange, and a rear hanger portion extending up from the central hanger portion generally at the back wall of the gutter, and a gutter cover in an installed position on the gutter, the gutter cover comprising a central cover portion, and a front cover portion formed integrally with the central cover portion and configured to extend downward from the central cover portion to a location below the gutter flange, said front cover portion including a plurality of louver drains, each louver drain of said plurality of louver drains comprising a drain opening and a raised louver above the drain opening positioned to contact the gutter flange to limit uplift of the front cover portion of the gutter cover, wherein the front cover portion of the gutter cover is configured as a continuous sheet not formed from mesh or expanded metal, wherein each raised louver of said plurality of louver drains comprises an arch-like structure upset from the continuous sheet to form a respective drain opening below the arch-like structure, said arch-like structure defining at least one open mouth through which water can flow into the drain opening of the louver drain, and wherein the front cover portion of the gutter cover is bent to define a channel that receives but does not contact the front flange of the gutter to provide a continuous gap between the forward cover portion of the gutter cover and the front flange of the gutter for flow of water through the gap to said louver drains.

14. The gutter system of claim 13, wherein the at least one open mouth of the arch-like structure faces upstream relative to the flow of water along the forward cover portion.

15. The gutter system of claim 13, wherein said arch-like structure defines first and second open mouths facing in substantially opposite directions.

16. The gutter system of claim 13, further comprising a rear cover portion formed integrally with the central cover portion, and wherein the gutter cover is configured such that said front and rear cover portions of the gutter cover are resiliently urged against respective front and rear hanger portions of the gutter hanger when the gutter cover is in said installed position.

17. The gutter system of claim 13, wherein said front cover portion comprises an upper bend integrally connecting the central portion to the front portion, a lower bend below the upper bend, an upper leg extending downward from the upper bend, and a lower leg extending forward from the lower bend.

18. The gutter system of claim 17, wherein at least some of the louver drains are on the lower leg.

19. The gutter system of claim 17, wherein at least some of the louver drains are on the upper leg.

20. The gutter system of claim 17, wherein the louver drains are on the upper and lower legs.

21. The gutter system of claim 17, wherein the lower leg extends generally parallel to and immediately above the central hanger portion for increasing the debris-load capacity of the gutter cover.

22. The gutter system of claim 17, wherein the lower leg terminates in a front edge in contact with a front bend of the gutter hanger connecting the central hanger portion and the front hanger portion.

23. The gutter system of claim 13, wherein the central cover portion and the front cover portion of the gutter cover are of sheet metal, and wherein the at least one open mouth is located at one side of the arch-like structure and above the drain opening of a respective louver drain.

24. An elongate gutter cover for covering a gutter supported by a gutter hanger, the gutter having a front wall, a back wall, a bottom wall, and a flange projecting rearward from the front wall and spaced above the bottom wall of the gutter, the gutter cover comprising a central cover portion configured to overlie the gutter when the gutter cover is in an installed position on the gutter, and a front cover portion formed integrally with the central cover portion and configured to extend downward to a location below the gutter flange when the gutter cover is in said installed position, said front cover portion including a plurality of louver drains, each louver drain of said plurality of louver drains comprising a drain opening and a raised louver above the drain opening, wherein each raised louver of said plurality of louver drains comprises an arch-like structure upset from the continuous sheet to form a respective drain opening below the arch-like structure, said arch-like structure defining at least one open mouth through which water can flow into the draining opening of the louver drain, and wherein the front cover portion of the gutter cover comprises an upper bend integrally connecting the central cover portion to the front cover portion, a lower bend below the upper bend, an upper leg extending downward and rearward from the upper bend and connecting the upper and lower bends, and a lower leg extending forward from the lower bend, said louver drains being located on the lower leg.

25. A gutter system comprising an elongate gutter having front, back and bottom walls and a flange projecting rearward from the front wall and spaced above the bottom wall of the gutter, a hanger supporting the gutter, the hanger having a central hanger portion, a front hanger portion extending up from the central hanger portion to a location below the gutter flange, and a rear hanger portion extending up from the central hanger portion generally at the back wall of the gutter, and a gutter cover in an installed position on the gutter, the gutter cover comprising a central cover portion, and a front cover portion formed integrally with the central cover portion and configured to extend downward from the central cover portion to a location below the gutter flange, said front cover portion including a plurality of louver drains, each louver drain of said plurality of louver drains comprising a drain opening and a raised louver above the drain opening positioned to contact the gutter flange to limit uplift of the front cover portion of the gutter cover, wherein the front cover portion of the gutter cover is configured as a continuous sheet not formed from mesh or expanded metal, wherein each raised louver of said plurality of louver drains comprises an arch-like structure upset from the continuous sheet to form a respective drain opening below the arch-like structure, said arch-like structure defining at least one open mouth through which water can flow into the drain opening of the louver drain, and wherein the front cover portion of the gutter cover comprises an upper bend integrally connecting the central cover portion to the front cover portion, a lower bend below the upper bend, an upper leg extending downward and rearward from the upper bend and connecting the upper and lower bends, and a lower leg extending forward from the lower bend, said louver drains being located on the lower leg.

* * * * *